US008870312B2

(12) United States Patent
Tosin

(10) Patent No.: US 8,870,312 B2
(45) Date of Patent: Oct. 28, 2014

(54) DIFFERENTIATED PULL-OUT CHEST OF DRAWERS

(75) Inventor: Giuseppe Tosin, Bassano del Grappa (IT)

(73) Assignee: Fami S.R.L., Rosa (IT)

( * ) Notice: Subject to any disclaimer, the term of this patent is extended or adjusted under 35 U.S.C. 154(b) by 255 days.

(21) Appl. No.: 13/323,377

(22) Filed: Dec. 12, 2011

(65) Prior Publication Data

US 2012/0153795 A1 Jun. 21, 2012

(30) Foreign Application Priority Data

Dec. 16, 2010 (IT) ..... MO2010A0354

(51) Int. Cl.

*A47B 88/16* (2006.01)
*A47B 67/04* (2006.01)
*A47B 88/14* (2006.01)

(52) U.S. Cl.

CPC *A47B 67/04* (2013.01); *A47B 88/14* (2013.01)
USPC ..... 312/334.45; 312/334.12

(58) Field of Classification Search

CPC ..... A47B 88/047; A47B 88/10; A47B 88/14; A47B 88/16; A47B 2210/0081; A47B 2210/0016
USPC ..... 312/257.1, 330.1, 334.1, 334.7, 334.8, 312/334.12, 334.18, 334.39, 334.44, 312/334.45, 333, 334.19, 334.16
See application file for complete search history.

(56) References Cited

U.S. PATENT DOCUMENTS

| | | | | |
|---|---|---|---|---|
| 1,969,749 | A * | 8/1934 | Harsh | 292/73 |
| 2,730,423 | A * | 1/1956 | Mock | 312/334.22 |
| 2,871,085 | A * | 1/1959 | Diack | 312/334.12 |
| 3,203,749 | A | 8/1965 | Bullock et al. | |
| 3,746,418 | A * | 7/1973 | Barber, Jr. | 312/334.45 |
| 4,121,878 | A * | 10/1978 | Lokken | 312/334.45 |
| 4,315,661 | A * | 2/1982 | Kessler | 312/334.19 |
| 4,333,690 | A | 6/1982 | Keefe et al. | |
| 5,490,724 | A * | 2/1996 | Domenig | 312/334.45 |
| 5,634,703 | A * | 6/1997 | Vonier | 312/334.12 |
| 5,823,649 | A * | 10/1998 | Hinrichs | 312/334.45 |
| 6,682,158 | B2 * | 1/2004 | Lai | 312/333 |
| 7,905,561 | B2 * | 3/2011 | Ritter | 312/333 |

FOREIGN PATENT DOCUMENTS

| | | |
|---|---|---|
| DE | 30 48 756 A1 | 10/1981 |
| DE | 20 2007 014389 U1 | 3/2008 |
| GB | 2 093 334 A | 9/1982 |

* cited by examiner

*Primary Examiner* — James O Hansen
(74) *Attorney, Agent, or Firm* — Pearne & Gordon LLP

(57) ABSTRACT

A differentiated pull-out chest of drawers (1), comprising: a containment frame (2) for at least one drawer (6), which is movable between a closed position in which it is contained within the volumetric dimensions of said frame (2) and an open position in which it projects out from said frame (2) to a preset length; moving means (8) of the drawer (6), interposed between a pair of side uprights (3) of the frame (2) and said drawer (6) to make the drawer (6) slidable between the closed position and the open position; and an adjusting member (12) of the open position of the drawer (6) to determine the preset length of projection of the drawer (6) from the frame (2).

4 Claims, 4 Drawing Sheets

DIFFERENTIATED PULL-OUT CHEST OF DRAWERS

The present invention relates to a differentiated pull-out chest of drawers, particularly a tool chest of drawers. Such chests of drawers find application prevalently in workshops, joineries, carpentry workshops and generally in all places where it is necessary to put various types of work tools back in an orderly fashion.

Chests of drawers of this type are generally made of sheet metal, by means of suitable bending of the sheet metal itself.

As is known, the chests of drawers are constituted by a frame, normally having a parallelepiped shape, with which a plurality of drawers are associated.

More specifically, the frame comprises two uprights facing each other. Such uprights each have a front edge and a rear edge. Moreover, the uprights are fastened to a base and are interconnected by an upper panel.

In particular, the drawers cited hereinabove are associated with the uprights so as to enable them to slide with respect to the latter in order to be inserted in and pulled out of the chest of drawers. Moreover, each drawer comprises a front portion, to which a handle is fastened.

The chest of drawers comprises a pair of guides for every drawer. Each guide in every pair is connected to an inside wall of a respective upright. Furthermore, each guide comprises a cylindrical bearing that slides with respect to a rail fastened to an outside sidewall of the drawer. In this manner, each drawer proves to be movable along a respective pair of guides. In greater detail, a slide is fastened to each rail and by engaging a respective guide, the slide facilitates the sliding of the drawer thereon.

As a result, each drawer can travel from a closing configuration, in which it proves to be contained inside the frame, to a pull-out configuration and vice versa. More specifically, each drawer is housed between the uprights in the closing configuration, and projects with respect to the cited front edge of the uprights in the pull-out configuration. Note that the aforesaid slide abuts against the bearing when the drawer is in the pull-out configuration, in which it proves to be almost completely pulled out for easy access to the rear area of the drawer.

The drawers may be of differentiated dimensions in order to permit objects of various dimensions to be contained. Furthermore, the drawers may be realized in a differentiated manner based on the maximum load they must sustain. For example, some drawers are reinforced in several structural parts so as to enable to them sustain very heavy objects. The sliding guides are also suitably dimensioned to enable them to sustain the drawer containing heavy objects even in the respective open state in which it projects almost completely out of the frame.

The drawer of the prior art has a major drawback. In fact, the drawers capable of containing particularly heavy objects prove to be structurally complicated given the presence of the reinforcements or other strengthening structures.

Moreover, the presence of drawers that differ one from the other has a considerable cost in terms of economic costs and time in the stages of production of the entire chest of drawers.

In this context, the technical task underlying the present invention is to propose a chest of drawers that overcomes the aforesaid drawbacks of the prior art.

More specifically, an aim of the present invention is to make available a chest of drawers that is of simple construction and economical, capable of containing objects of any weight without having to differentiate the structure of the individual drawers.

The set technical task and the specified aims are substantially achieved by a chest of drawers comprising the technical characteristics stated in one or more of the appended claims.

Further characteristics and advantages of the present invention will become more apparent from the indicative, and thus non-limiting, description of a preferred, though not exclusive, embodiment of a chest of drawers, as illustrated in the appended drawings, wherein.

Figure 1:
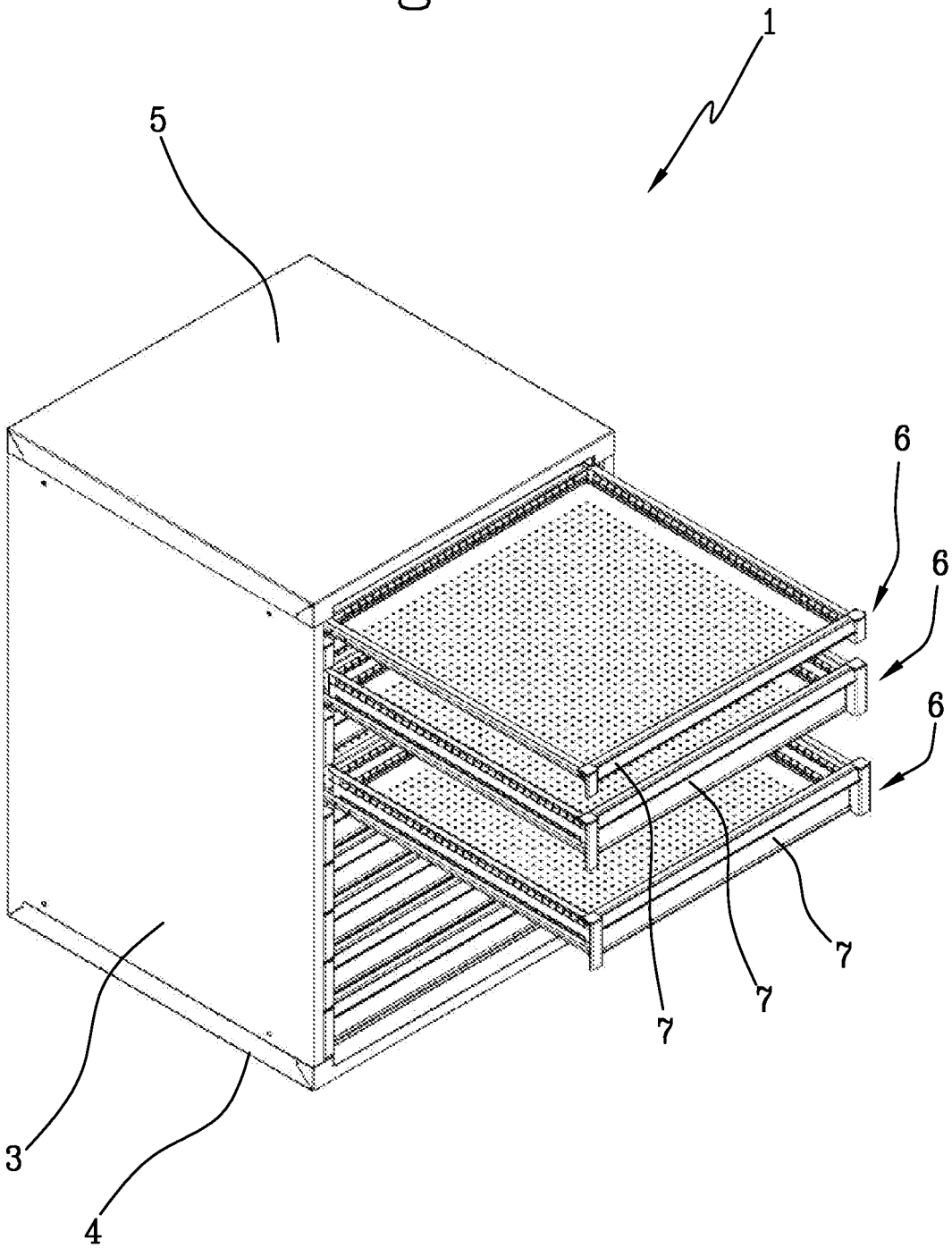
FIG. 1 is a perspective view of a chest of drawers according to the present invention.

With reference to the appended figures, 1 indicates a chest of drawers according to the present invention. More specifically, the embodiment of the chest of drawers 1 described hereinafter refers to a tool chest of drawers 1.

The chest of drawers 1 comprises a frame 2 having two side uprights 3, facing each other. Furthermore, the frame 2 comprises a supporting base 4, suitable for sustaining the cited uprights 3, and preferably an upper panel 5 that is also connected to the uprights 3 and is opposite the base 4.

Each upright 3 has a front edge 3*a*. More specifically, the front edges 3*a* define the aperture of the chest of drawers 1 inside of which the drawers 6 are housed.

In greater detail, each drawer 6 defines a housing compartment for the objects to be placed in the chest of drawers and it is slidably associated with the uprights 3 so as to slide with respect to the latter.

As shown in the appended figures, the chest of drawers 1 may comprise a plurality of drawers 6. The number and dimensions of such drawers 6 may vary according to utilization needs and the dimensions of the entire chest of drawers 1.

Each drawer 6 comprises a front portion 7 provided with a handle 7*a* predisposed to be gripped by a user, who can move the drawer 6 between a closed position in which it is contained within the volumetric dimensions of the frame 2, and an open position in which it projects out from the frame 2 to a preset length.

In other words, in the open (pull-out) configuration the drawer 6 projects with respect to the front plane of the chest of drawers 1 as defined by the edges 3*a* of the uprights 3. Likewise, in the closing configuration, the drawer 6 does not project with respect to the front plane. Advantageously, this makes the chest of drawers 1 safer, in that when all the drawers 6 are in the closing configuration, there are no protruding parts that can become entangled in the power cords of the workshop tools.

Figure 2:
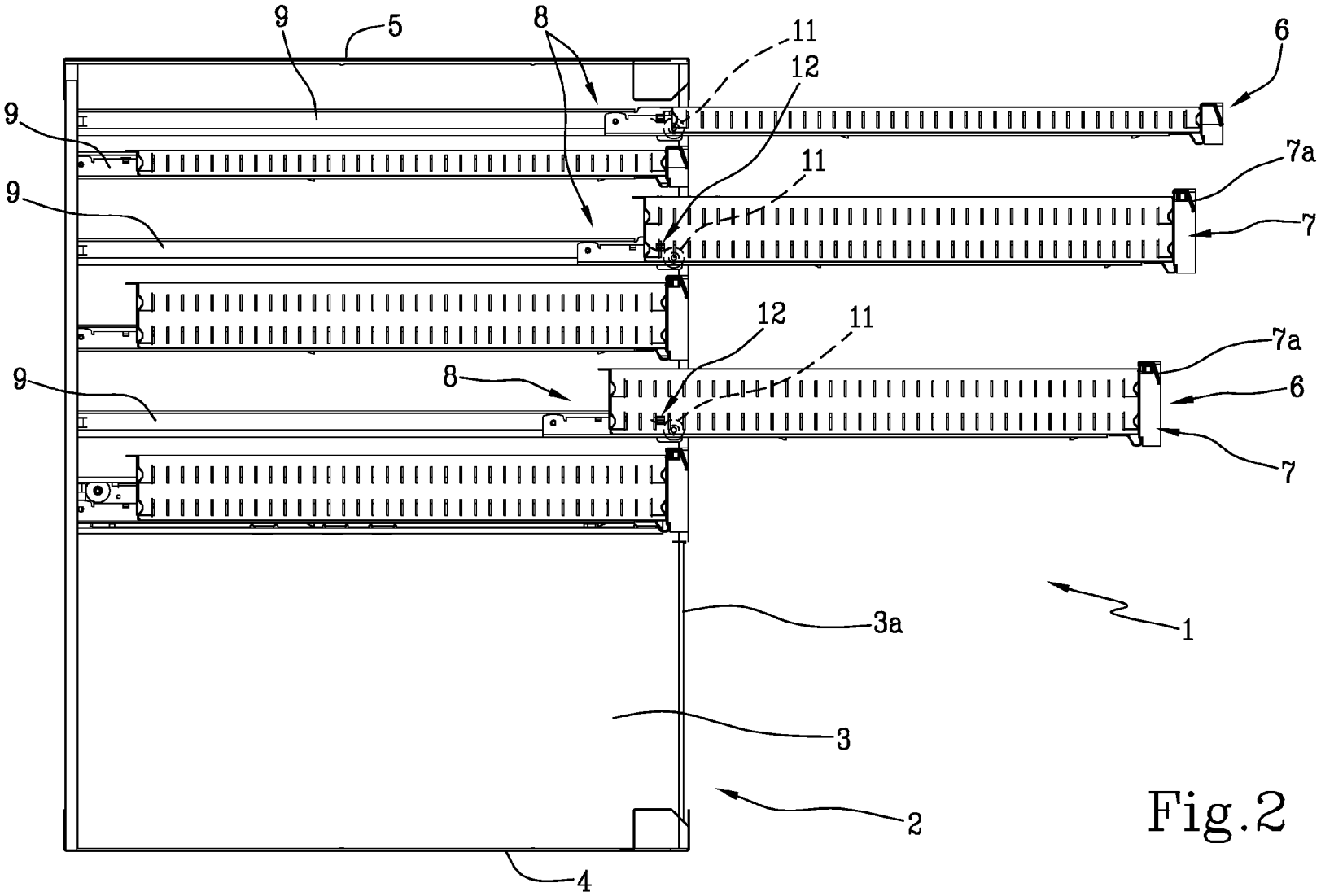
FIG. 2 is a side elevation and partial sectional view of the chest of drawers of FIG. 1 in a state of aperture of some drawers.

As illustrated more clearly in FIG. 2, the chest of drawers 1 comprises moving means 8 of the drawers 6, interposed between the side uprights 3 and each drawer 6. Such moving means 8 is suitable for making the drawer slidable between the closed position and the open position.

More specifically, the moving means 8 has a pair of guides 9, each being associated with an inside wall of a respective upright 3. In this manner, for each drawer 6, two guides 9 are provided, placed on the sides of the drawer 6 itself, which proves to be slidable along the guides 9.

Furthermore, the moving means 8 has a pair of rails 10 coupled to each drawer 6.

Each rail 10 is made up of a profile section, associated with a side of the drawer and operatively coupled to the respective guide 9 to slide thereon between the closed position and the open position of the drawer 6.

In this manner, the rail 10 and the respective guide 9 prove to be associated and sliding with respect to each other and along a direction corresponding to the longitudinal extension of the guide 9 and the rail 10.

Note also that in the closed position of the drawer 6, the rail 10 and the guide 9 prove to overlap each other, whereas in the open position of the drawer 6, the rail 10 projects out in cantilever fashion from the frame 2 and the respective guide 9.

Moreover, the moving means 8 further comprises at least one rolling cylinder 11, pivoted to a respective guide 9 in a front zone of the frame 2. The cylinder 11 has a cylindrical outer surface suitable for rolling over a flat surface 10*a* obtained on the rail 10 and more clearly visible in the details appearing in FIGS. 3 and 3*a*.

In this manner, when the drawer 6 is moved into the respective closed or open position, the rail 10 is slid over the cited cylinder 11, obtaining smooth and easy movement of the drawer 6.

The chest of drawers 1 further comprises an adjusting member 12 of the open position of the drawer 6, suitable for determining a preset length of projection of the drawer 6 from the frame 2.

In other words, the adjusting member 12 defines the maximum aperture of the drawer 6, preventing the drawer from extension beyond a given length. Preferably, the adjusting member 12 proves to be interposed between the rail 10 and the guide 9 to interfere on the cylinder 11 and interrupt its rolling.

More specifically, the adjusting member 12 can be coupled to the rail 10 in a preset position of the rail 10 itself, corresponding to the maximum projection of the drawer 6 in the open position.

Figure 3:
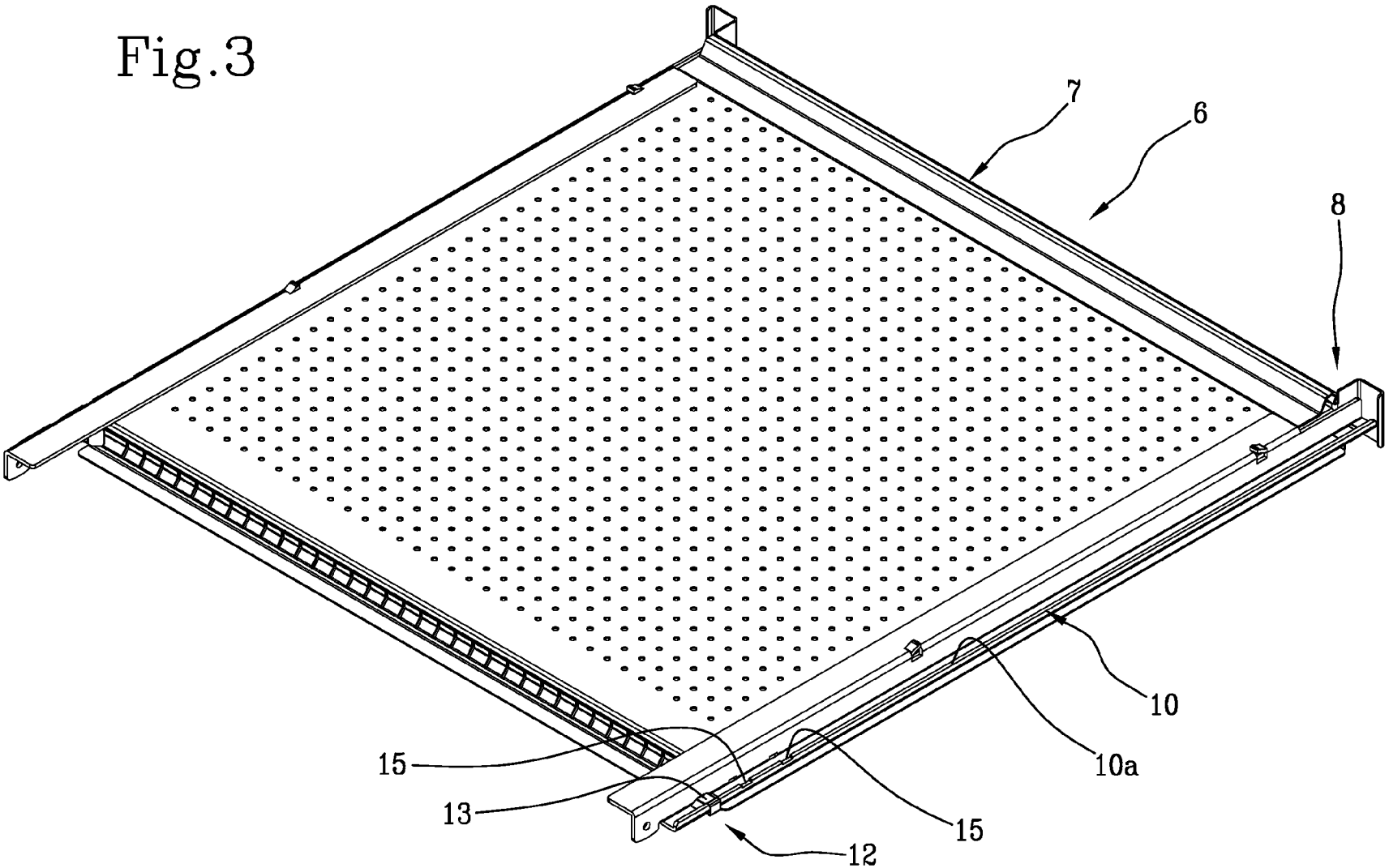
FIG. 3 is a perspective view of a drawer contained in the chest of drawers.
Figure 3A:
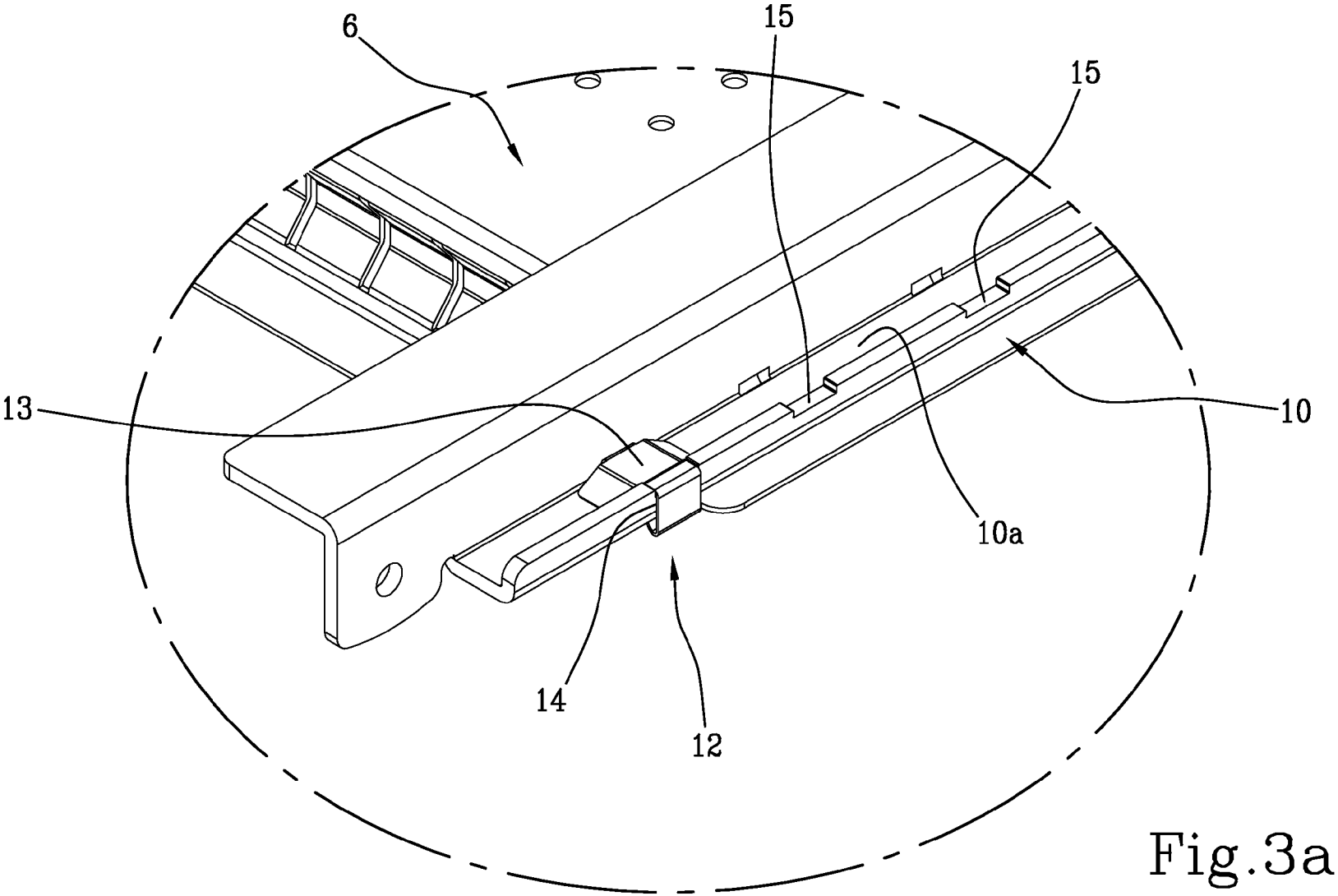
FIG. 3*a* is an enlarged view of a construction detail of the drawer of FIG. 3.

As illustrated more clearly in FIGS. 3 and 3*a*, the adjusting member 12 comprises a hooking element 13, having a substantially "C"-shaped portion 14.

The "C"-shaped portion 14 is predisposed to hook onto an edge of the rail 10, in a recessed zone 15 obtained on the cited rail 10.

In further detail, each rail 10 has a plurality of recessed zones 15 that are spaced and each one of which corresponding to a preset maximum weight value that the drawer 6 can sustain.

In this manner, based on the zone 15 to which the cited hooking element 13 can be coupled, the maximum aperture of the drawer 6 with respect to the frame 2 is defined.

In fact, it should be noted that the hooking element 13 constitutes a lock (a stop) that prevents rotation of the rolling cylinder 11. Advantageously, when the drawer 6 is opened, the cylinder 11 slides on the rail 10 until it meets the hooking element 13.

Note also that a maximum weight load that the drawer 6 can sustain is determined on the basis of how far the drawer 6 projects from the frame 2. In other words, to predispose drawers 6 capable of sustaining heavy loads, the hooking element 13 is associated in a manner that prevents the drawer from projecting excessively with respect to the frame.

Therefore, the hooking element 13 is positioned on the rail 10 according to the load that the drawer 10 must sustain.

Advantageously, drawers having identical structural characteristics can be realized. In this manner, the drawer is predisposed to sustain a predetermined load simply by modifying the positioning of the hooking element 13 on the rail 10.

The chest of drawers 1 thus has drawers having the same structural characteristics with the consequent advantages in the stages of production of the chest of drawers itself.

The invention claimed is:

1. A differentiated pull-out chest of drawers (1), comprising:

a containment frame (2) for at least one drawer (6), which is movable between a closed position in which it is contained within the volumetric dimensions of said frame (2) and an open position in which it projects out from said frame (2) to a preset length; and moving means (8) of the drawer (6), interposed between a pair of side uprights (3) of the frame (2) and said drawer (6) to make the drawer (6) slidable between the closed position and the open position, the moving means (8) further comprising at least one roller cylinder (11); wherein it further comprises an adjusting member (12) of the open position of the drawer (6) to determine the preset length of projection of the drawer (6) from the frame (2), wherein said adjusting member (12) comprises a hooking element (13) constituting a stop that prevents rotation of the rolling cylinder (11), the hooking element (13) being configured to be coupled to the drawer (6) in a preset position selected from a plurality of preset positions that are spaced and each one of which corresponds to a preset maximum weight value that the drawer (6) can sustain, wherein at least one rail is associated with said drawer, said rail comprising a profile section extending laterally to said drawer and having a plurality of recessed zones that are spaced one another and each one of which corresponding to a preset maximum weight value that the drawer can sustain, and wherein the hooking element has a substantially "C"-shaped portion configured to be integrally coupled to one of a plurality of recessed zones on the rail defining the preset position on the rail corresponding to the length to which the drawer projects out from the frame whereby the maximum aperture of the drawer with respect to the frame is defined.

2. The differentiated pull-out chest of drawers according to claim 1, characterized in that said moving means (8) comprises: at least one guide (9) connected to an inside wall of a side upright (3); at least said rail (10) associated with said drawer (6) and operatively coupled to the respective guide (9) to slide thereon between the closed position and the open position; said hooking element (13) being interposed between the rail (10) and the guide (9).

3. The differentiated pull-out chest of drawers according to claim 2, characterized in that said rolling cylinder (11) is pivoted to said guide (9) at a front zone of the frame (2), and rollable over said rail (10).

4. The differentiated pull-out chest of drawers according to claim 1, characterized in that it comprises a plurality of drawers (6) and at least a pair of guides (9) for each drawer (6), each guide (9) comprising an adjusting member (12) of the open position of the drawer (6).

* * * * *